US012660866B2

(12) United States Patent
Hammond et al.

(10) Patent No.: US 12,660,866 B2
(45) Date of Patent: Jun. 23, 2026

(54) GARMENT WITH A SUPPORT STRUCTURE

(71) Applicant: LULULEMON ATHLETICA CANADA INC., Vancouver (CA)

(72) Inventors: Connor Alexander Hammond, Vancouver (CA); David Whitt Sagan, Lake Oswego, OR (US); Adrian Ka Ming Lai, Coquitlam (CA)

(73) Assignee: LULULEMON ATHLETICA CANADA INC., Vancouver (CA)

( * ) Notice: Subject to any disclaimer, the term of this patent is extended or adjusted under 35 U.S.C. 154(b) by 0 days.

(21) Appl. No.: 18/846,197

(22) PCT Filed: Mar. 17, 2023

(86) PCT No.: PCT/CA2023/050357
§ 371 (c)(1),
(2) Date: Sep. 11, 2024

(87) PCT Pub. No.: WO2023/173231
PCT Pub. Date: Sep. 21, 2023

(65) Prior Publication Data

US 2025/0194702 A1 Jun. 19, 2025

Related U.S. Application Data

(60) Provisional application No. 63/321,628, filed on Mar. 18, 2022.

(51) Int. Cl.
*A41C 3/02* (2006.01)
*A41C 3/00* (2006.01)

(52) U.S. Cl.
CPC ..... *A41C 3/02* (2013.01); *A41C 3/0014* (2013.01); *A41C 3/0057* (2013.01)

(58) Field of Classification Search
None
See application file for complete search history.

(56) References Cited

U.S. PATENT DOCUMENTS 1,980,767 A * 11/1934 Snader ..... A41C 3/00 D2/708
2,786,205 A * 3/1957 Payne ..... A41C 3/06 450/83

(Continued)

FOREIGN PATENT DOCUMENTS

CN 213463847 U * 6/2021
EP 3216360 A1 * 9/2017 ..... A41C 3/0064

(Continued)

OTHER PUBLICATIONS

International Search Report and Written Opinion for PCT/CA2023/050357 dated Jun. 23, 2023.

*Primary Examiner* — Grace Huang

(57) ABSTRACT

Examples of a garment with a support structure are disclosed. The garment includes a front portion, a back portion, and first and second side portions. The front portion covers a portion of a wearer's chest and includes a lower edge, an upper edge portion, and first and second sides. The back portion covers a portion of the wearer's back, and includes a lower edge, an upper edge portion, and first and second sides. The first and second side portions extend between the front and back portions, and include lower edges. The first and second side portions include two or more stretching module zones that have a low stretching module zone in proximity to the arm openings of the garment and a lower edge stretching module zone in proximity to the first and second lower edges.

18 Claims, 11 Drawing Sheets

(56) References Cited

U.S. PATENT DOCUMENTS

D181,141 S * 10/1957 Gould ..... D2/706
2,869,554 A * 1/1959 Hollar ..... A41C 3/00 450/74
2,969,067 A * 1/1961 Smith ..... A41C 3/00 450/74
3,263,685 A * 8/1966 Bernfeld ..... A41C 3/00 450/86
3,392,732 A * 7/1968 Holscher ..... A41C 3/00 450/74
3,433,229 A * 3/1969 Tuschman ..... A41C 3/00 450/74
3,478,747 A * 11/1969 Sachs ..... A41C 3/00 450/59
3,566,878 A 3/1971 Radomski
3,595,243 A * 7/1971 Mount ..... A41C 3/0007 450/68
5,873,767 A * 2/1999 Pickett ..... A41C 3/08 450/91
6,165,045 A * 12/2000 Miller ..... A41C 3/0057 450/17
6,790,122 B2 * 9/2004 Mitchell ..... A41C 5/00 450/75
D513,829 S * 1/2006 Moens ..... D2/706
7,081,035 B2 * 7/2006 Kawakami ..... A41C 3/005 450/59
7,244,167 B2 * 7/2007 Falla ..... A41C 5/005 450/39
9,149,076 B2 * 10/2015 Almog ..... A41C 3/06
9,345,273 B2 * 5/2016 Luxi ..... A41C 3/0007
10,201,192 B1 2/2019 Lott
10,368,590 B2 * 8/2019 Diaz ..... D04B 35/10
10,441,003 B2 * 10/2019 Goodwin ..... A41C 3/142
2006/0243000 A1 11/2006 Turlan et al.
2007/0281583 A1 * 12/2007 Sakabe ..... A41C 3/04 450/1
2012/0028541 A1 * 2/2012 Donnelly ..... A41C 3/0021 450/86
2017/0290376 A1 10/2017 Maheshwari et al.
2019/0174840 A1 * 6/2019 Paulson ..... A41C 3/0014
2020/0323278 A1 10/2020 Roddis et al.
2025/0261706 A1 * 8/2025 Schütte-Bruns ..... A41C 3/0035

FOREIGN PATENT DOCUMENTS

FR 2655242 A1 * 6/1991 ..... A41B 17/00
GB 923279 A * 4/1963 ..... A41C 3/00
JP 2021031813 A * 3/2021

* cited by examiner

GARMENT WITH A SUPPORT STRUCTURE

FIELD OF INVENTION

This invention relates to garments and more particularly to garments with engineered support structures.

BACKGROUND OF THE INVENTION

Typical athletic garments are designed to provide support and movement management of a tissue, such as breast tissue, by restricting the movement and/or acceleration of breast tissue during activity. For example, typical athletic bras are designed to restrict the movement of breast tissue related to activity by uniformly compressing the breast tissue to the wearer's chest utilizing stiffer fabrics and a large number of components to lock down the breast tissue. While the garment may provide adequate movement management during activity, the compression that the garment exerts against the body can also be uncomfortable for the wearer. For example, tight garments can restrict tidal volume (the amount of air that can move through the wearer's chest in one breathe), thereby increasing the pressure to the ribcage applied by, for example, a bra underband, or pressure around the diaphragm applied by, for example, a pant waistband.

Thus, there exists a need for engineered support structures for garments that can create pressure application for movement management of tissue, while also supporting unrestricted breathing activity.

SUMMARY OF THE INVENTION

In various embodiments, the present disclosure provides a garment with a support structure that provides support and movement management of a tissue, such as breast tissue, without unnecessarily restricting the respiratory cycles of a wearer.

In one aspect, the present disclosure provides a garment comprising a front portion covering at least a portion of a wearer's chest, the front portion comprising a front portion lower edge, a front portion upper edge portion, a first side of the front portion and a second side of the front portion; a back portion covering at least a portion of the wearer's back, the back portion comprising a back portion lower edge, a back portion upper edge portion, a first side of the back portion and a second side of the back portion; a first side portion extending between the first side of the front portion and the second side of the back portion, the first side portion having a first lower edge; and a second side portion extending between the second side of the front portion and the first side of the back portion, the second side portion having a second lower edge, wherein at least a part of the first and second side portions comprise two or more stretching module zones, the two or more stretching module zones comprising a low stretching module zone in proximity to a first arm opening and a second arm opening, respectively, of the garment, and a lower edge stretching module zone in proximity to the first lower edge and the second lower edge, respectively.

In various embodiments, the first and second side portions may be engineered such that a stretching level of the two or more stretching module zones increases gradually from the low stretching module zone towards the lower edge stretching module zone.

In various embodiments, the first and second side portions may be engineered such that the two or more stretching module zones extend radially downward pivoting from the low stretching module zone toward the lower edge stretching module zone.

In various embodiments, each of the first and second side portions may comprise a triangular shaped gusset, wherein the triangular shaped gusset is engineered such that the two or more stretching module zones extend radially downward pivoting from the low stretching module zone toward the lower edge stretching module zone.

In various embodiments, the garment further comprises a pair of reinforcing elements extending from the first side portion and the second side portion, respectively, toward the front portion, each of the pair of reinforcing elements being engineered to have varying stretching modules, wherein bottom zones of each of the pair of reinforcing elements closer to a lower edge of the garment have stretching levels greater than top zones of the reinforcing elements closer to an upper edge of the garment.

In various embodiments, each of the pair of reinforcing elements may comprise a first leg extending at least partially in a top part of the front portion in proximity to the front portion upper edge portion and a second leg extending at least partially in a bottom part of the front portion in proximity to the front portion lower edge, wherein at least part of the first and the second leg is shaped to provide lateral support of a breast tissue around a root of each breast. For example, each of the pair of reinforcing elements may be U-shaped, V-shaped, X-shaped or Y-shaped.

In various embodiments, each of the pair of reinforcing elements may comprise a pair of crisscrossing legs configured to extend from the front portion across the respective side portion toward the back portion, the first leg having a first end in proximity to the front portion upper edge portion and a second end in proximity to the back portion lower edge, and the second leg having a first end in proximity to the front portion lower edge and a second end in proximity to the back portion upper edge portion.

In various embodiments, stretching levels of the varying stretching modules of each of the reinforcing elements may increase gradually from the top zones of the reinforcing elements toward the bottom zones of the reinforcing elements.

In various embodiments, the garment may further comprise an underband at the lower edge of the front portion, the back portion and each of the first and second side portions. In various embodiments, the underband may be engineered such that a zone closer to a lower edge of the underband along each of the first and second side portions has a stretching module level greater than a zone further away from the lower edge of the underband.

In various embodiments, the underband is engineered such that a zone closer to a lower edge of the underband has a stretching module level greater than a zone further away from the lower edge of the underband. In various embodiments, stretching levels of the varying zones of the underband may increase gradually towards the zone closer to the lower edge of the underband.

In various embodiments, the underband has a concave shape from a front and a back view of the garment, with a depression of the concave shape at center portions of the underband, such that a stretching level at sides of the underband is greater than at the center portions.

In various embodiments, the garment further comprises one or more openings on the front portion, the back portion, the first side portion, the second side portion, the underband, or a combination thereof, wherein the one or more openings create one or more zones with a higher stretching level compared to zones of the garment without the one or more openings, and wherein the one or more zones with the higher stretching level is controlled by a size and/or density of the one or more openings. The one or more openings may comprise a mesh. In various embodiments, a zone with a lower stretching level may be adjacent the one or more openings. In various embodiments, the one or more openings may be on a central part of the front portion, a central part of the back portion, a central part of the underband, or a combination thereof. In various embodiments, the zone with the lower stretching level adjacent the one or more openings may be on an underband of the garment.

In various embodiments, the garment further comprises one or more zones on a center part of the front portion, a center part of the back portion, a center part of the underband or a combination thereof, having a higher stretching level compared to zones of the front portion, back portion and underband without the one or more zones having the higher stretching level.

In various embodiments, each of the first and second side portions may further comprise a discontinuous overlay, wherein the overlay is coupled to the first or second side portion on an inside surface or on an outside surface of the first or second side portion, respectively. The term "inside surface" refers to the surface of the first and second side portions facing the wearer when the wearer is wearing the garment. The term "outside surface" refers to the surface of the first and second side portions facing away from the wearer when the wearer is wearing the garment.

In various embodiments, the garment further comprises one or more shoulder straps connecting the front portion and the back portion over one or both shoulders of the wearer.

In addition to the aspects and embodiments described above, further aspects and embodiments will become apparent by reference to the drawings

BRIEF DESCRIPTION OF THE DRAWINGS

Throughout the drawings, reference numbers may be re-used to indicate correspondence between referenced elements. The drawings are provided to illustrate example embodiments described herein and are not intended to limit the scope of the disclosure. Sizes and relative positions of elements in the drawings are not necessarily drawn to scale. For example, the shapes of various elements and angles are not drawn to scale, and some of these elements are arbitrarily enlarged and positioned to improve drawing legibility.

In the accompanying drawings, which illustrate one or more exemplary embodiments.

DETAILED DESCRIPTION

Reference will now be made in detail to embodiments of the invention, examples of which are illustrated in the accompanying drawings. While the invention is described in conjunction with these embodiments, it will be understood that the descriptions herein are not intended to limit the invention to these embodiments. On the contrary, the invention is intended to cover alternatives, modifications, and equivalents that may be included within the scope of the invention as defined by the appended claims. Detailed description of components that are well known in the art may be omitted if that detailed description would confuse or obscure the description of the embodiments of the present invention.

In the context of the present disclosure, various terms are used in accordance with what is understood to be the ordinary meaning of those terms.

Directional terms such as "top", "bottom", "front", "back", "upper", "lower", "outer" and "inner" are used in the following description for the purpose of providing relative reference only, and are not intended to suggest any limitations on how any article or garment is to be positioned during use, or relative to an environment. The use of the word "a" or "an" when used herein in conjunction with the term "comprising" may mean "one", but it is also consistent with the meaning of "one or more", "at least one", and "one or more than one". Any element expressed in the singular form also encompasses its plural form. Any element expressed in the plural form also encompasses its singular form. The term "plurality" as used herein means more than one, for example, two or more, three or more, for or more, and the like.

The present disclosure provides a garment with a support structure. In various embodiments, the disclosure provides garments that provide support and movement management of a tissue, such as breast tissue, particularly during activity, without unnecessarily restricting the respiratory cycles of a wearer.

Figure 1A:
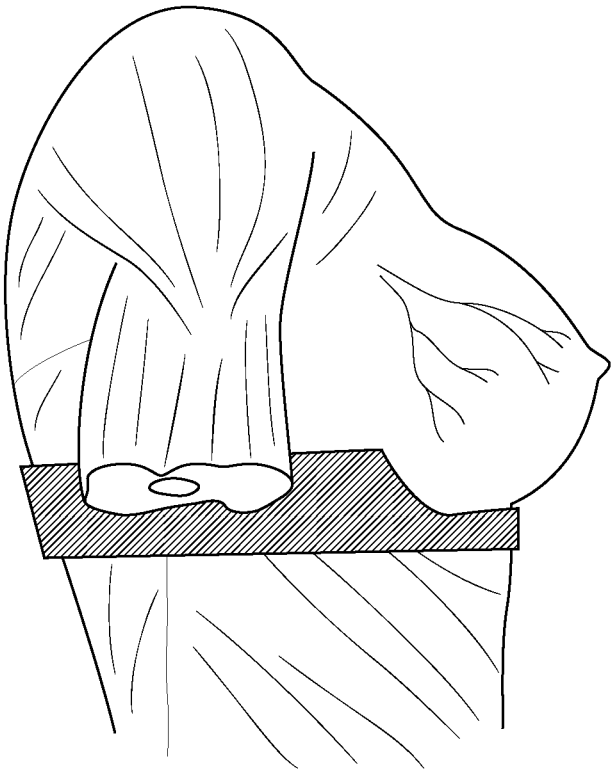
FIG. 1A (Prior Art)
FIG. 1A is a side schematic view of an under band of a prior art athletic garment against a body of a wearer.

During activity, breast tissue has a range of motion. Prior art garments typically manage this motion by compressing the breast tissue against a wearer's chest. These prior art garments also include an underband, which wraps around a ribcage of the wearer (FIG. 1A). Although such garments provide at least some comfort for movement of breast tissue, they may create significant discomfort around the ribcage of the wearer, by restricting expansion of the ribcage during respiratory cycles, particularly heavy breathing during exercise.

For example, in order to understand the impact of pressure and/or compression exerted by prior art garments, such as sport bras, on mechanical work performed by the respiratory muscles to breathe during activity, experiments have been conducted in which athletes were asked to exercise while wearing a sport bra which was adapted to fit more tightly or loosely around the rib cage, using the bra fastener, such as a hook and eye fastener, to adjust the pressure exerted by the bra underband against the upper body of the wearer. When fit more tightly, the sport bra exerted more pressure against the wearer's body as compared to when it fit more loosely.

The mechanical work performed by the respiratory muscles to meet ventilation demands during exercise is called "work of breathing" (WOB) and is measured from the volume of air in each breath and the pressure generated by the respiratory muscles, and indicates how much pressure or muscular energy is required to move a given volume of air. WOB can be resistive WOB, such as the work required to overcome the resistance or air flow, or elastic WOB which is the work required to overcome tissue deformation, such as, for example, the chest wall, lungs and/or airways.

Experiments such as those described above have shown that during exercise, increased tightness in the underband of a bra increases the WOB by about 6% compared to a bra with a looser underband, meaning that the pressure exerted by the underband in sport bras can induce greater mechanical work to breathe. This in turn affects breathing patterns during exercise which can lead to respiratory muscle fatigue. However, prior art sport bras have typically been designed to provide greater breast support to reduce breast tissue acceleration during activity, meaning that greater pressures are exerted against the body of the wearer by the sport bra itself and the underband.

Figure 1B:
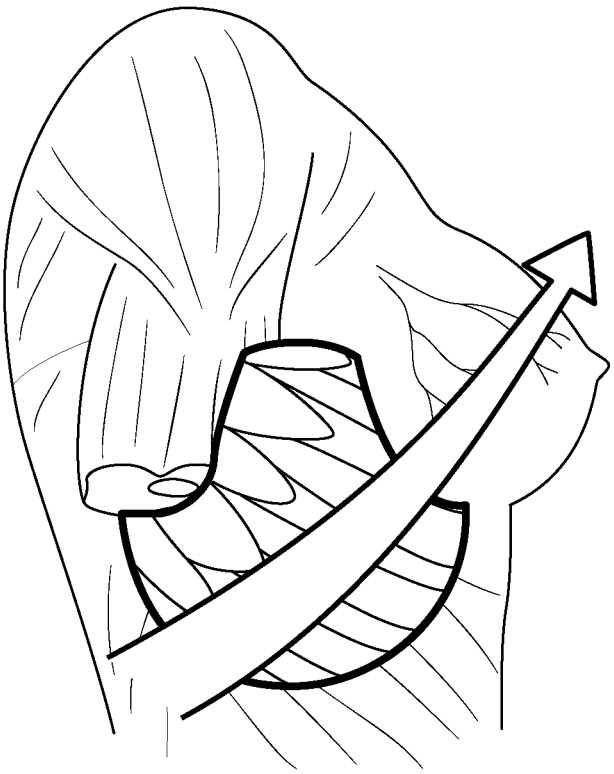
FIG. 1B is a side schematic view of a rib cage of a person showing a direction of expansion of the rib cage during respiratory cycles.
Figure 1C:
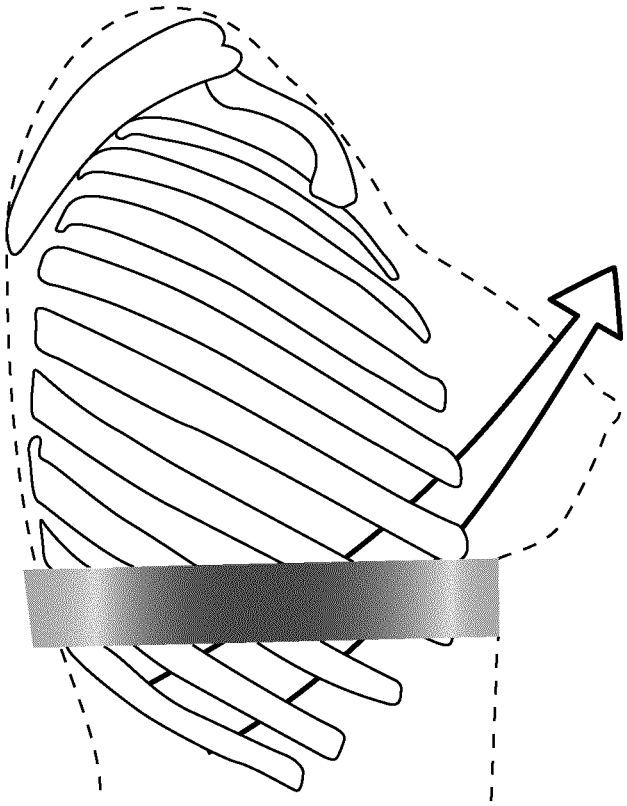
FIG. 1C (Prior Art)
FIG. 1C is a side plan view of the location on the under band of the prior art athletic garment where most of the pressure of the under band is applied against the rib cage of the wearer, corresponding to the sides of the rib cage of the wearer.
Figure 1D:
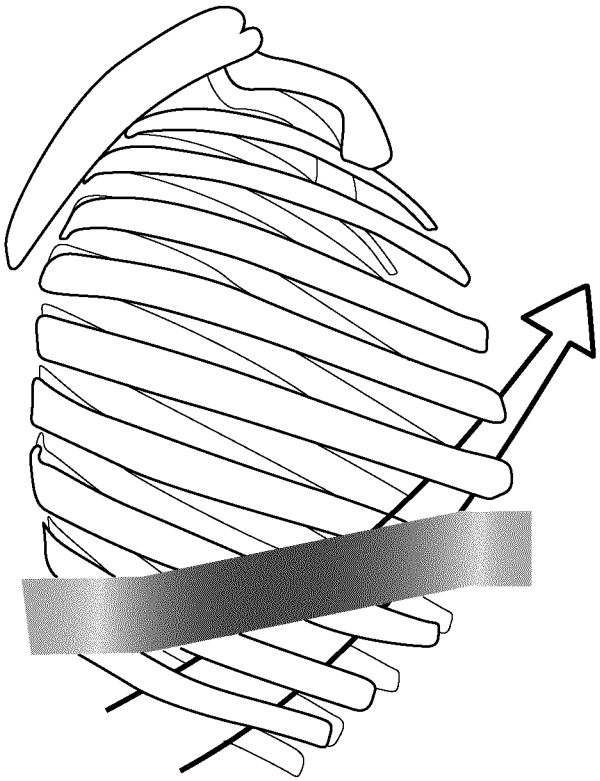
FIG. 1D (Prior Art)
FIG. 1D is a side plan view showing movement of the under band of the prior art athletic garment during an inhale by the wearer and the pressure of the under band against the rib cage of the wearer, particularly at the side of the rib cage.

As shown in FIG. 1B, rib cage kinematics during respiration show that the rib cage expands upwardly and outwardly during an inhale and relax back down during an exhale. This expansion of the rib cage outwardly and upwardly results in the rib cage pressing against the underband of a typical prior art garment, with a significant amount of the pressure felt against the side of the rib cage, as shown in FIG. 1C at rest, and in FIG. 1D during inhale. As described above, this pressure may cause significant discomfort for the wearer and increase the WOB, particularly during activity when a wearer may be breathing more deeply and/or more heavily.

Thus, the garments of the present disclosure are directed to allowing for natural expansion of the rib cage during respiration along the sides of the garment, while maintaining movement management of the breast tissue. In various embodiments, the garment expands and has reduced stiffness, or an increased level of stretching, in areas overlaying the side of the rib cage of the wearer, to allow for less pressure against the rib cage of the wearer during respiratory cycles.

The terms "stretching level", "stretching module level" or "levels of stretching" refer to the ability of the fibers of a cloth or fabric to be made or be capable of being made longer and/or wider without breaking or tearing the fibers. Upon release of the stretch, the fibers then return to their original length and/or width. The cloth or fabric may be either two-way stretching or four-way stretching, two-way stretching being a cloth or fabric that can stretch and recover lengthwise or in width, and be rigid in the other direction, and four-way stretching being a cloth or fabric that can stretch and recover both lengthwise and in width.

Figure 2:
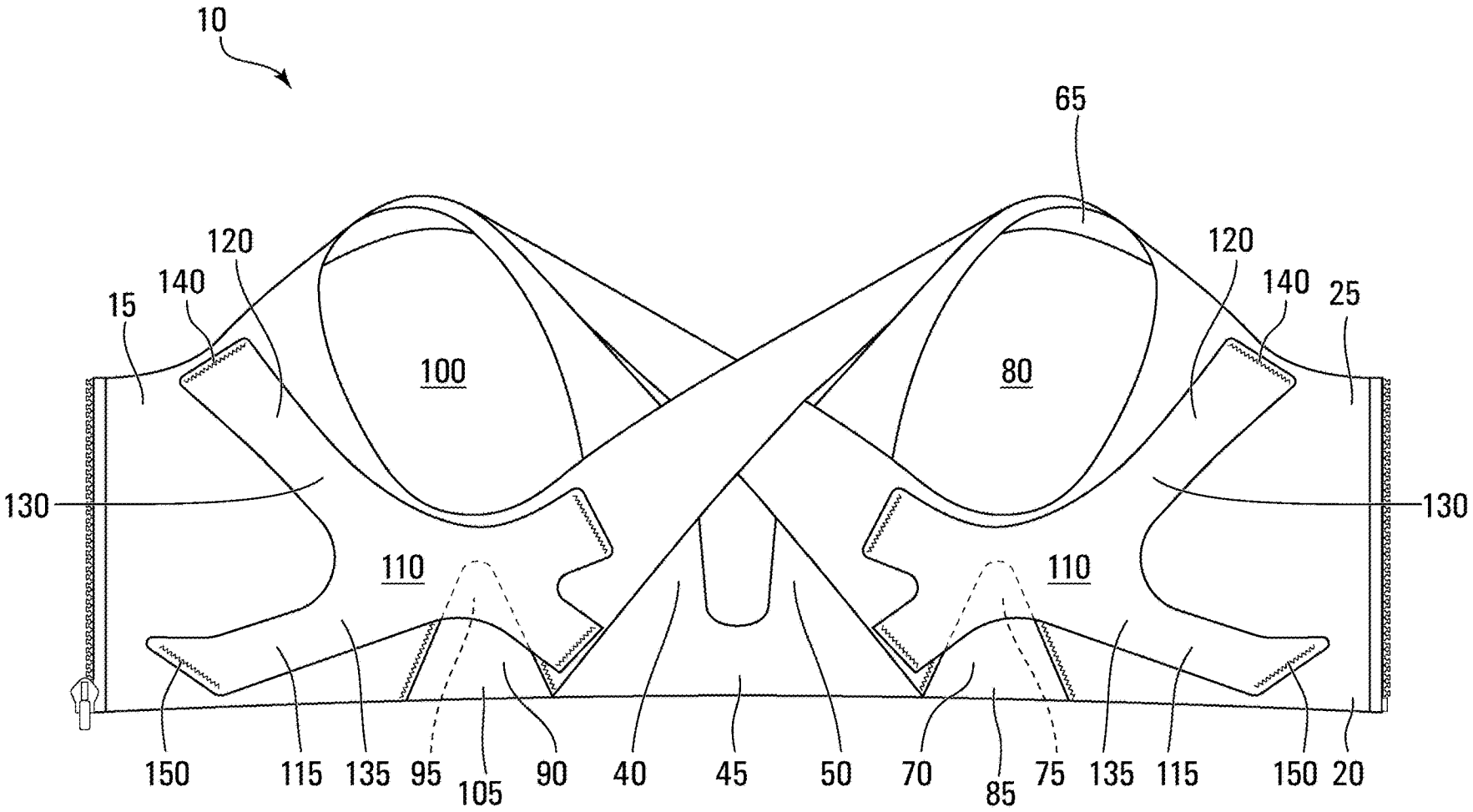
FIG. 2 is a back plan view of an exterior of a garment with a support structure in accordance with an embodiment of the invention, where the garment is in an open position.
Figure 3:
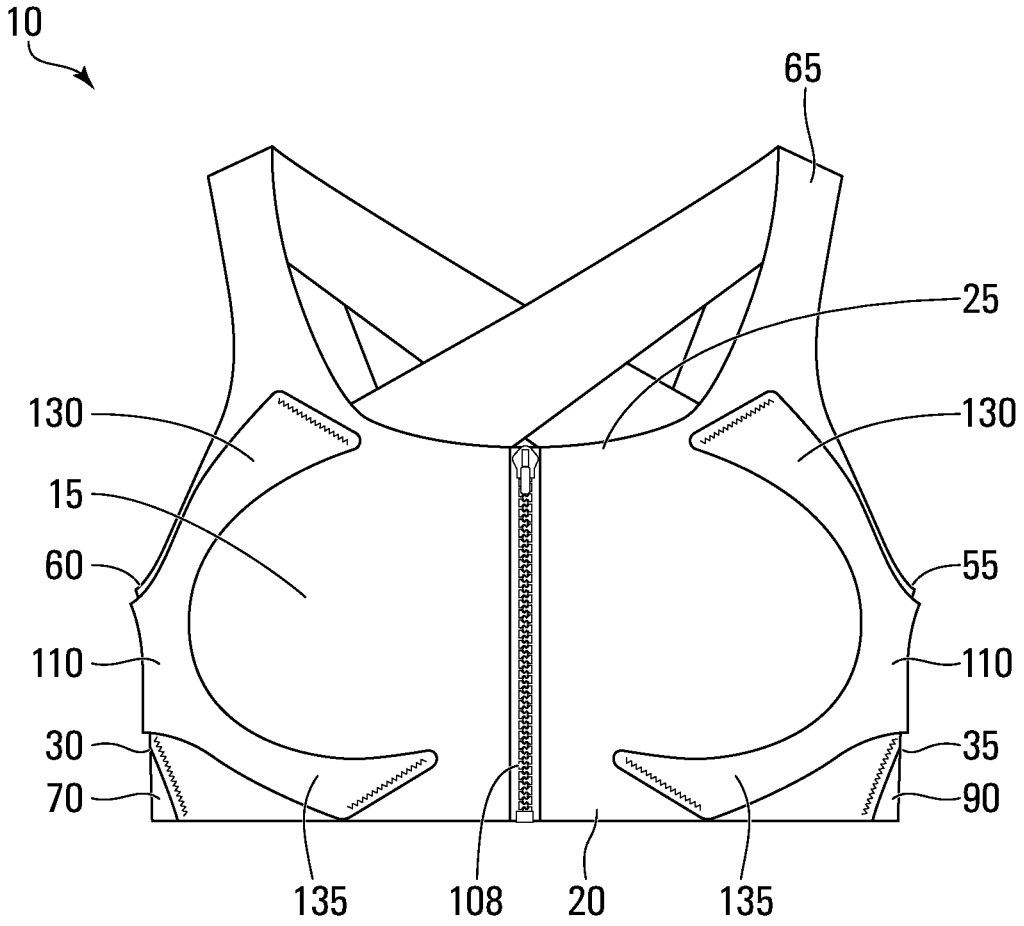
FIG. 3 is a front plan view of a garment with a support structure in accordance with an embodiment of the invention, where the garment is in a closed position.

Referring to FIGS. 2 and 3, and according to a first embodiment of the disclosure, a garment 10 with a support structure is shown. The garment 10 comprises a front portion 15 covering at least a portion of a wearer's chest, the front portion 15 comprising a front portion lower edge 20, a front portion upper edge portion 25, a first side 30 of the front portion 15 and a second side 35 of the front portion 15. The garment 10 also comprises a back portion 40 covering at least a portion of the wearer's back. The back portion 40 comprises a back portion lower edge 45, a back portion upper edge portion 50, a first side 55 of the back portion 40 and a second side 60 of the back portion 40.

In various embodiments, the garment 10 may also comprises one or more shoulder straps 65 connecting the front portion 15 and the back portion 40 over one or both shoulders of the wearer. In various embodiments, the one or more shoulder straps 65 may be continuous with or connected seamlessly with the front portion 15 and the back portion 40.

The garment 10 further comprises a first side portion 70 extending between the first side 30 of the front portion 15 and the second side 60 of the back portion 40, the first side portion 70 comprising a first lower edge 85.

The garment 10 also comprises a second side portion 90 extending between the second side 35 of the front portion 15 and the first side 55 of the back portion 40, the second side portion 90 comprising a second lower edge 105.

In various embodiments, the first and second side portions 70 and 90, respectively, may be connected seamlessly to the front portion 15, the back portion 40, both the front and back portions 15 and 40, respectively, the one or more shoulder straps 65, or any combination thereof. For example, the front portion 15 and the first and second side portions 70 and 90, respectively, may be knit as one piece, or the front portion 15, the back portion 40, and the first and second side portions 70 and 90, respectively, may be knit as one continuous piece. The different levels of stretching for different modules and/or zones of the garment 10 can be engineered by, for example, using different coatings on a surface of the garment 10, or adding inner panels and/or middle layers between panels to the garment 10, or by using different yarn combinations or knitting stitches or techniques. In various embodiments, different modules and/or zones of the garment 10 can be achieved by applying adhesive between inner and outer panels of the garment 10. The adhesive can be applied as a pattern, such as a dotted pattern, and by changing the density and/or size of the adhesive pattern, such as the density and/or size of adhesive dots, the direction and stretching level of the garment 10 can be modified. In alternative embodiments, the fabric of the garment 10 and/or the yarn in the fabric may have non-linear properties that allow different gradients of stretching, depending on the level and/or direction of force applied to the garment 10. For example, such fabrics can have higher stretch when the force applied thereto is lower, such as during a low intensity activity when the WOB is lower, and then become more rigid with lower stretch when the force applied thereto is higher, such as during a high intensity activity when the WOB is higher. In further embodiments, the direction of the level of stretch between different portions of the garment 10 can be modified, such that, for example, some portions of the garment 10 have a two-way stretching level and other portions of the garment 10 have a four-way stretching level.

At least part of the first and second side portions 70 and 90, respectively, comprise two or more stretching module zones, the two or more stretching module zones comprising a low stretching module zone 75 and 95 in proximity to the first arm opening and the second arm opening 80 and 100, respectively, and a lower edge stretching module zone in proximity to the first lower edge 85 and the second lower edge 105, respectively. The low stretching module zone has a lower stretching level than the lower edge stretching module zone. In various embodiments, the two or more stretching module zones have a higher stretching level than the front portion 15, the back portion 40 and the one or more shoulder straps 65. By having the two or more stretching module zones in the first and second side portions 70 and 90, respectively, the rib cage of the wearer may expand more easily against the pressure of the garment 10 as compared to garments that do not comprise the engineered first and second side portions 70 and 90. Thus, the garment 10 provides support and movement management for the breast tissue of the wearer, while also allowing the wearer to breath comfortably. The garment 10 has increased stretching levels in areas corresponding to the rib cage of the wearer that move the most during respiratory cycles.

In various embodiments, the garment 10 may further comprise an opening, such as the zipper opening 108 in the front portion 15 as shown in the Figures. In other embodiments, the garment 10 may not comprise an opening (the garment 10 is pulled on over the wearer's head, for example), or the opening may be located in the back portion 40, the first side portion 70 or the second side portion 90. The opening 108 may comprise any other fastening mechanism in addition to a zipper, as would be known to a person of ordinary skill in the art.

In various embodiments, and in order to further enhance the stretching level of the garment 10 in areas overlaying the portions of the rib cage that expand up and out during respiratory cycles while maintaining tissue support and movement management, the first and second side portions 70 and 90, respectively, may be engineered such that a stretching level of the two or more stretching module zones increases gradually from the low stretching module zone towards the lower edge stretching module zone. Alternatively, the first and second side portions 70 and 90, respectively, may be engineered such that the two or more stretching module zones extend radially downward pivoting from the low stretching module zone toward the lower edge stretching module zone.

Figure 4:
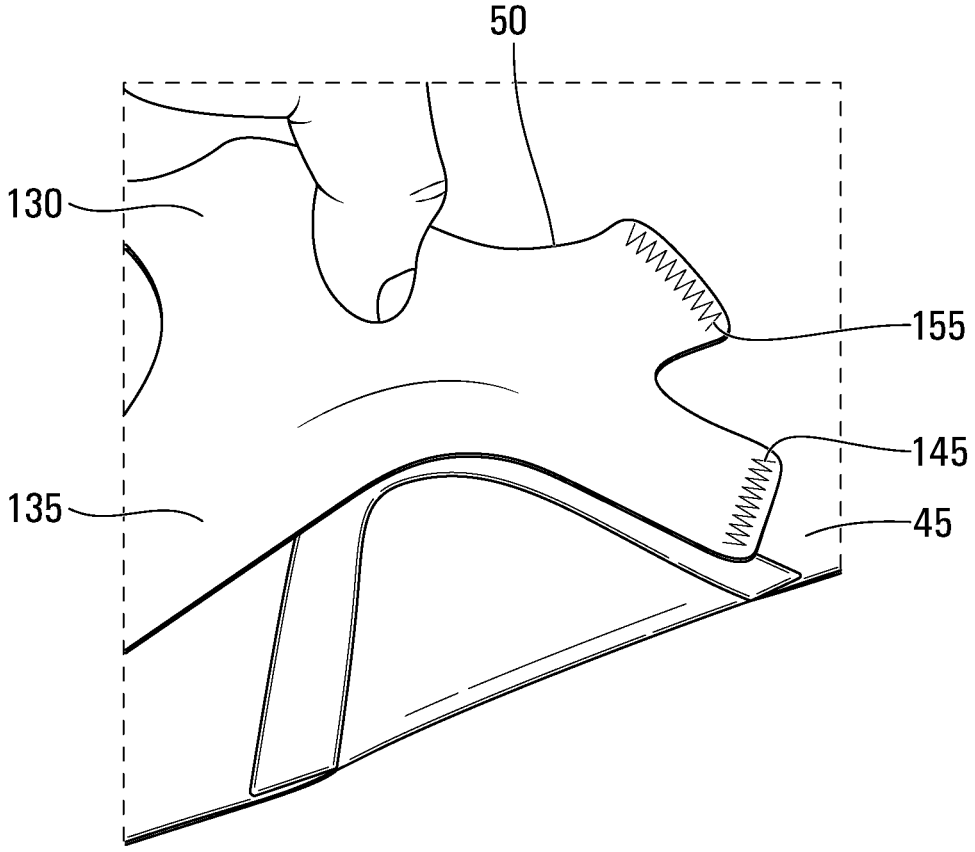
FIG. 4 is a perspective view of an exterior of a side portion and a reinforcing element of the garment as shown in FIG. 2.

In various embodiments, and as shown in FIGS. 2 and 4, each of the first and second side portions 70 and 90, respectively, can be shaped as a triangular gusset, wherein the triangular shaped gusset is engineered such that the two or more stretching module zones extend radially downward pivoting from the low stretching module zone, 75 and 95 toward the lower edge stretching zone. For example, the two or more stretching module zones may pivot radially downwards and outwards from an upper part of the triangular shaped gusset.

Figure 5A:
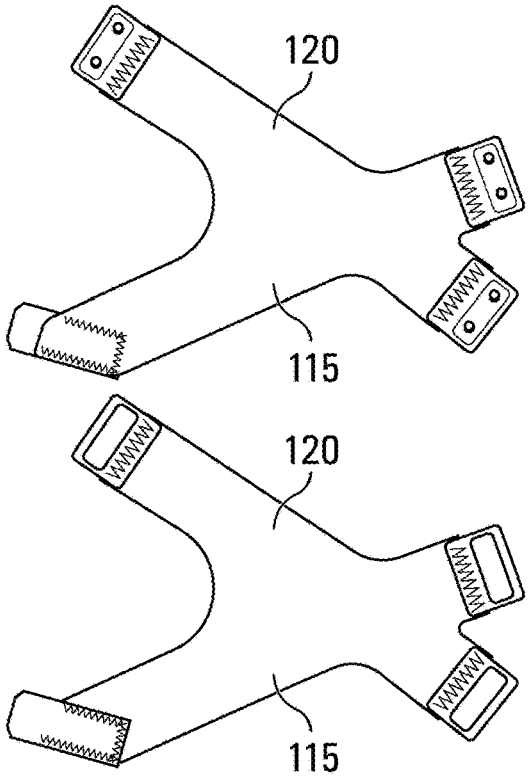
FIG. 5 shows first and second sides of a variety of pairs of reinforcing elements, including: a V-shape (FIG. 5A), a U-shape (FIG. 5B), a quadrilateral shape (FIG. 5C), a X-shape (FIG. 5D), an extended X-shape (FIG. 5E), a X-shape with reinforcing (FIG. 5F), and straight bars (FIG. 5G).
Figure 5B:
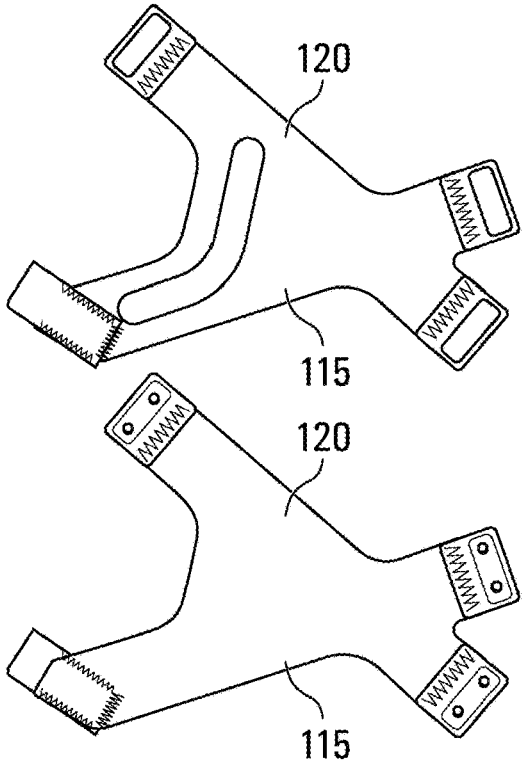
Figure 5C:
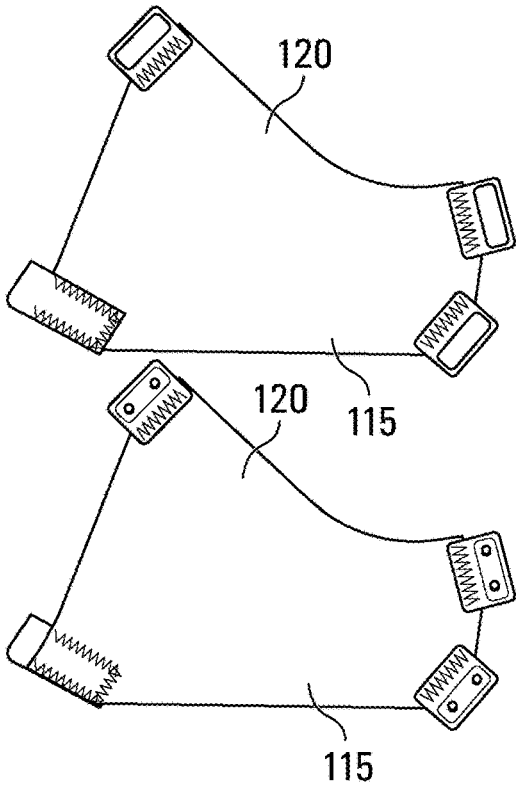
Figure 5D:
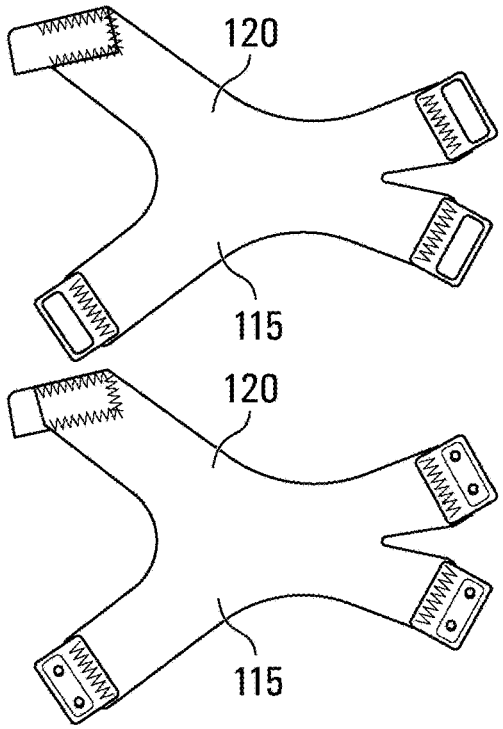
Figure 5E:
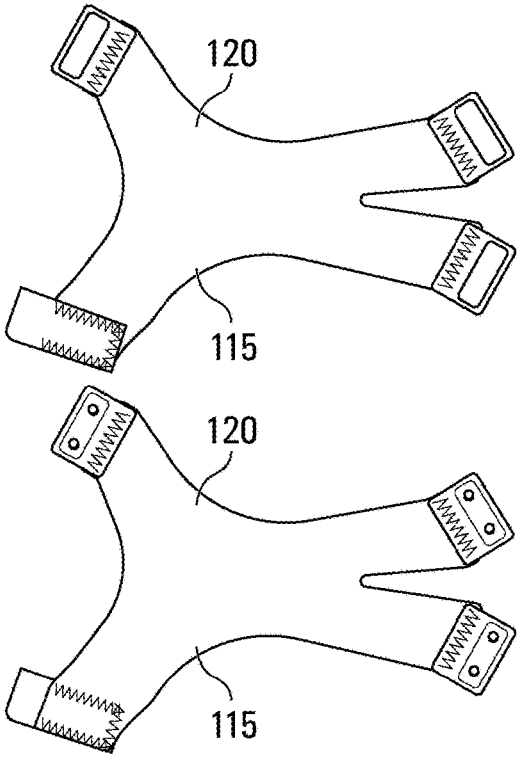
Figure 5F:
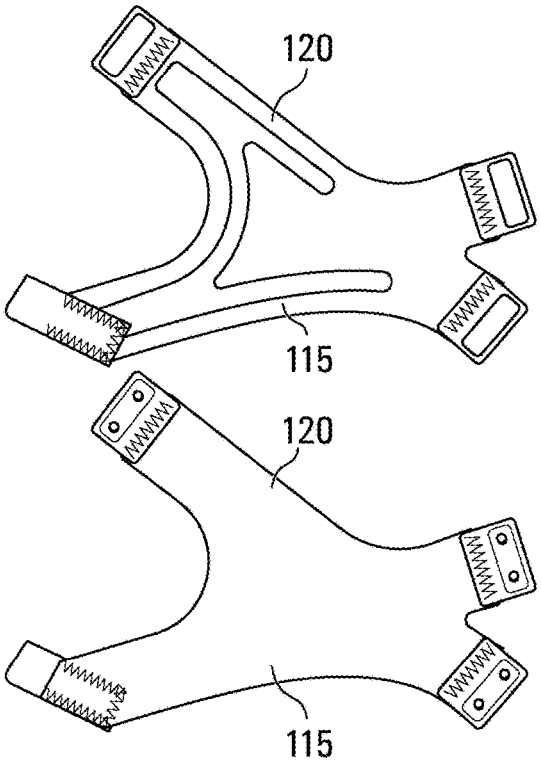
Figure 5G:
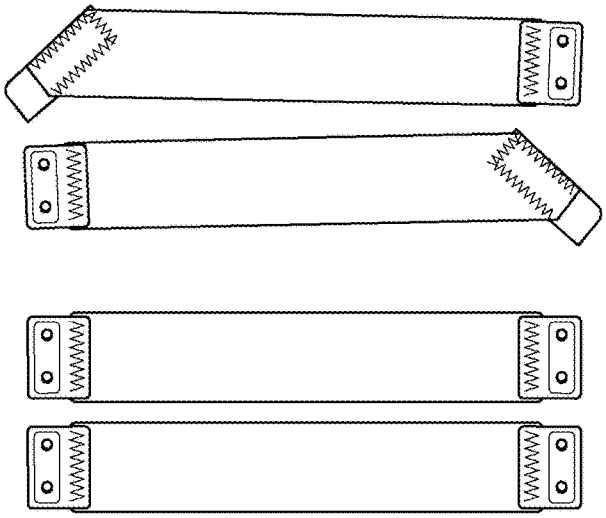

In various embodiments, and as shown in FIGS. 2-4, the garment 10 further comprises a pair of reinforcing elements 110 extending from the first side portion 70 and the second side portion 90, respectively, toward the front portion 15, each of the pair of reinforcing elements 110 being engineered to have varying stretching modules, wherein bottom zones 115 of each of the pair of reinforcing elements 110 closer to a lower edge of the garment 10 have stretching levels greater than top zones 120 of the reinforcing elements 110 closer to an upper edge of the garment. The stretching levels of the bottom zones 115 can be lower than the stretching levels of the lower edge stretching module zones of the first and second side portions 70 and 90, respectively. The pair of reinforcing elements 110 may be a variety of different shapes. For example, and as shown in FIGS. 5A-5G, each of the pair of reinforcing elements 110 may be V-shaped (FIG. 5A), U-shaped (FIG. 5B), quadrilateral shaped (FIG. 5C), X-shaped (FIG. 5D), extended X-shaped (FIG. 5E), X-shaped with reinforcing (FIG. 5F), or straight bars (FIG. 5G). Any of the various shapes may also include panels or sections of reinforcing, as shown in FIG. 5F.

In various embodiments, each of the pair of reinforcing elements 110 may comprise a first leg 130 extending at least partially into a top part of the front portion 15 in proximity to the front portion upper edge portion 25 and a second leg 135 extending at least partially into a bottom part of the front portion 15, in proximity to the front portion lower edge 20, wherein at least part of the first and second leg 130 and 135, respectively, is shaped to provide lateral support of a breast tissue around a root of each breast. For example, each of the pair of reinforcing elements 110 comprises a pair of criss-crossing legs 130 and 135 (FIGS. 5A, 5B, 5D-5F), and as shown in FIGS. 2 and 4, is configured to extend from the front portion 15 across the respective side portion toward the back portion 40, the first leg 130 having a first end 140 in proximity to the front portion upper edge portion 25 and a second end 145 in proximity to the back portion lower edge 45, and the second leg 135 having a first end 150 in proximity to the front portion lower edge 20 and a second end 155 in proximity to the back portion upper edge portion 50.

In various embodiments, the stretching levels of the varying stretching modules of each of the reinforcing elements 110 increases gradually from the top zones of each of the pair of reinforcing elements 110 toward the bottom zone of each of the pair of reinforcing elements 110.

In various embodiments, the garment 10 further comprises an underband joined at the front portion lower edge 20, the back portion lower edge 45, the first lower edge 85 and the second lower edge 105. The underband may be continuous with or connected seamlessly with the front portion lower edge 20, the back portion lower edge 45, the first lower edge 85 and the second lower edge 105. The underband may be engineered such that parts of the underband along the first lower edge 85 and the second lower edge 105 have a stretching level greater than the remainder of the underband, while parts of the underband along the front portion 15 and back portion 40 are not stretchable or have a low stretching level. The underband may also be engineered such that a zone closer to a lower edge of the underband has a stretching module level greater than a zone further away from the lower edge of the underband.

In some embodiments, the front portion 15 and back portion 40 may also be engineered to have varying stretching modules, such that modules closer to and/or part of the front portion upper edge portion 25 and/or the back portion upper edge portion 50 have a higher level of stretching compared to modules closer to and/or adjacent to the front portion lower edge 20 and/or the back portion lower edge 45. The transitions between the varying stretching modules may be gradual, defined, or a combination thereof. Further embodiments are described below.

Figure 6A:
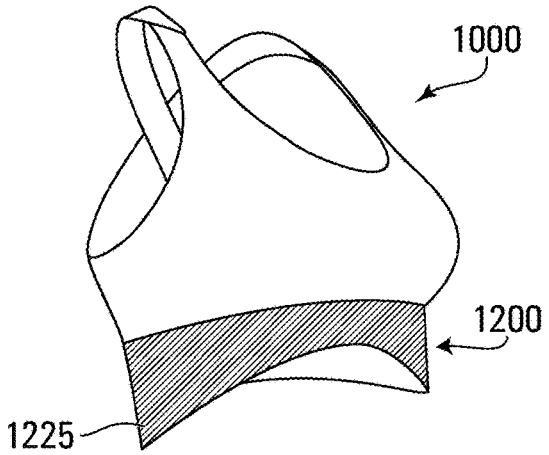
FIG. 6A is a perspective view of a garment with an underband having a concave shape, in accordance with an embodiment of the invention.
Figure 6B:
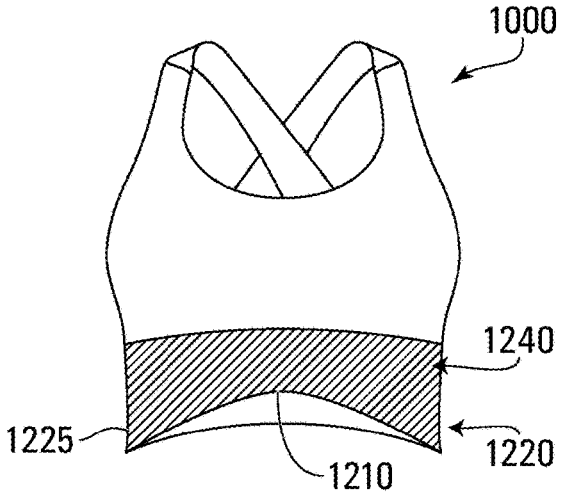
FIG. 6B is a front view of the garment of FIG. 6A.
Figure 6C:
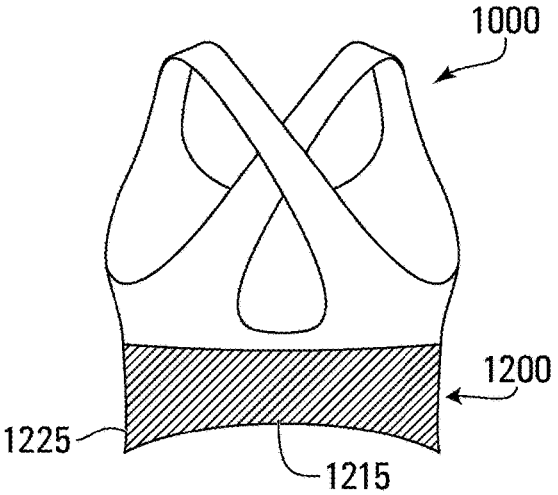
FIG. 6C is a back view of the garment of FIG. 6A.

FIGS. 6A-6C illustrates a further embodiment of the invention which provides support to breast tissue during activity while reducing respiratory restrictions caused by pressure of the garment against the body of the wearer. Garment 1000 comprises an underband 1200 that has a curved shape such that the underband is longer on its sides 1225 and gradually becomes shorter towards a central area at the front 1210 and back 1215 of the underband 1200. In other words, the underband 1200 has a concave shape when viewed from the front and back, with a depression of the concave shape at central areas 1210 and 1215 of the underband 1200. The central area at the front 1210 can be higher than, or the same as, the central area at the back 1215. In further embodiments, the central area at the front 1210 can be lower than the central area at the back 1215. The underband 1200 shaped to have shorter central areas 1210 and 1215 and longer sides 1225 may also assist in holding the garment 1000 in position during activity, and prevent the underband 1200 from "rolling up". The sides 1225 of the underband 1200 may have modules with higher stretching levels compared to the front and/or the back of the underband. In addition, the lower part 1220 of the underband 1200 (i.e. the area closer to a lower edge of the underband 1200), may have a higher stretching level than an upper part 1240 of the underband 1200 (i.e. the area closer to the lower edge of the front, back and first and second side portions of the garment 1000). The change in stretching level between the upper part 1240 and the lower part 1220 may increase gradually, be defined, or a combination thereof. For example, the lower part 1220 and the upper part 1240 can be knitted such that the lower edge is the most stretchy section of the underband and its upper edge is more rigid. The gradually changing stretching level may also be achieved with an adhesive pattern, such as a dot pattern, as described above, by changing the density and/or size of the adhesive dots, or by screen print coating. In various embodiments, the underband 1200 (and in some embodiments the entire garment) can be knitted and the gradually changing stretching levels may be achieved by modifying the yarns, stitches (for example, different stitch strength) and/or knitting construction.

Figure 7A:
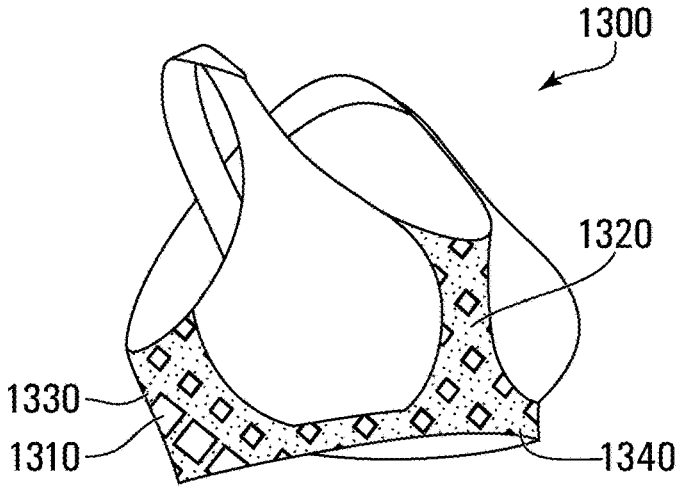
FIG. 7A is a perspective view of a garment with a plurality of openings on the front portion, the back portion, the first side portion, the second side portion and the underband, wherein the plurality of openings create one or more zones with a higher stretching level compared to zones of the garment without the one or more openings, in accordance with an embodiment of the invention.
Figure 7B:
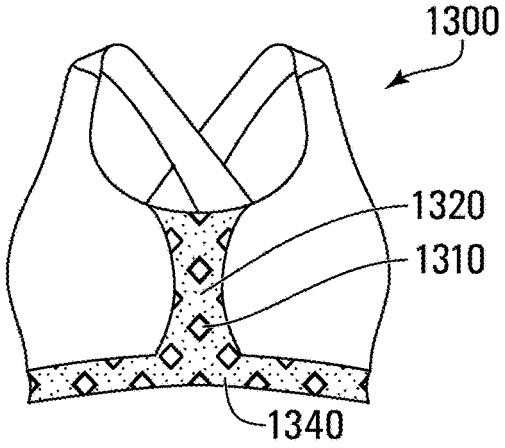
FIG. 7B is a front view of the garment of FIG. 7A.
Figure 7C:
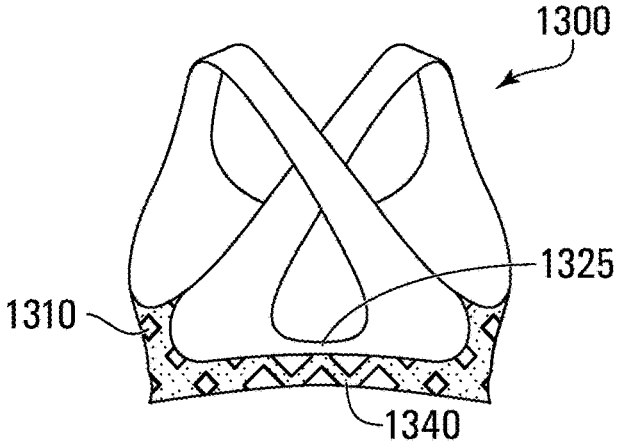
FIG. 7C is a back view of the garment of FIG. 7A.
Figure 7D:
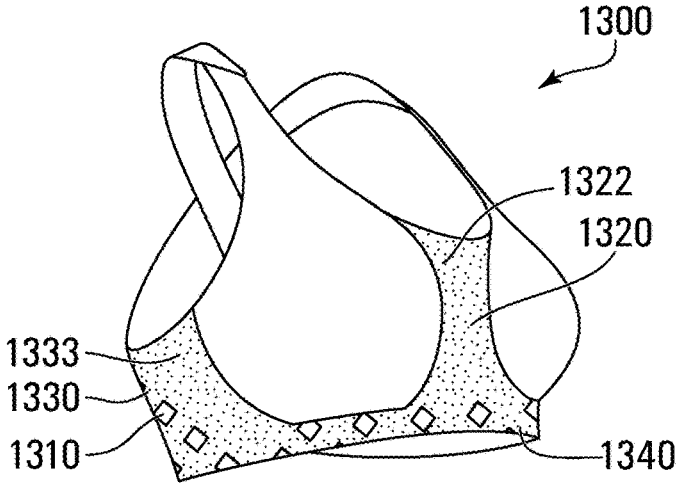
FIG. 7D is a perspective view of a garment with a plurality of openings on the first side portion, the second side portion and the underband, wherein the plurality of openings create one or more zones with a higher stretching level compared to zones of the garment without the one or more openings, in accordance with a further embodiment of the invention.

In various embodiments, different zones of stretching may be defined by creating one or more openings in portions of the garment where a higher stretching level is desired. Different stretching levels can be formed by controlling the size of the openings and/or controlling the density of the openings. The one or more openings can be designed such that portions of the garment may be two-way stretching or four-way stretching. The openings also provide for ventilation to aid in temperature management during activity. For example, FIGS. 7A-7D show a garment 1300 where different stretching levels are formed by a plurality of openings 1310 at a central front part of the garment between the two breast cups area 1320, a central back part 1325, first and second sides 1330, and/or the underband 1340. In various embodiments, the first and second sides 1330 of the garment 1300 can be engineered to have higher stretching levels to accommodate the breathing pattern of the wearer and expansion of the chest during exercise by providing larger openings 1310 (or higher density of openings 1310) to create a more open structure, while the central front part 1320 of the garment 1300 between the two breast cup areas and the front part of the underband 1340 can have a lower stretching level to provide the required support to manage breast tissue acceleration during activity and/or exercise. An example of this embodiment is shown in FIGS. 7A and 7C, where larger openings 1310 are seen at the sides of the garment 1330 and on the underband 1340 at the central back part 1325 of the garment 1300. In various embodiments, and as shown in FIG. 7D, portion 1322 of the front part of the garment between the two breast cups area 1320 may have no openings, or fewer or smaller openings, such that portion 1322 (which is closer to the breast cup areas) has a lower stretching level to provide support to manage medial breast tissue acceleration during activity and/or exercise. Similarly, portion 1333 of the first and second sides 1330 closer to the breast cups area (for example, closer to the root of the breast tissue) may have no openings or less or smaller openings, such that portion 1333 of the sides 1330 have a lower stretching level to provide support to manage lateral breast tissue acceleration during activity and/or exercise.

Figure 8A:
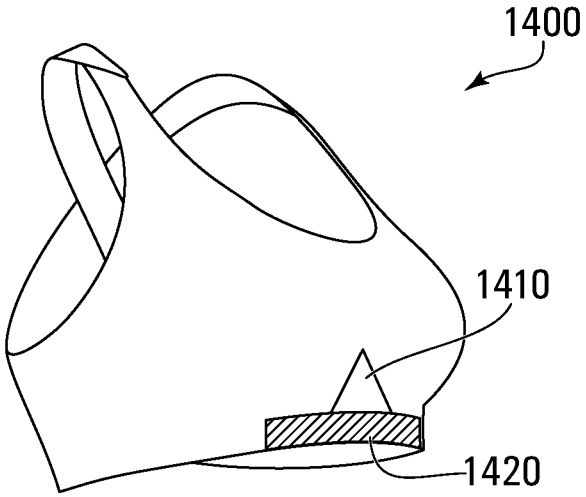
FIG. 8A is a perspective view of a garment with an opening on a central part of a front portion of a garment, in accordance with an embodiment of the invention. The opening on the central part of the front portion of the garment is adjacent a zone on the underband having a lower stretching level as compared to a stretching level of a remainder of the underband.
Figure 8B:
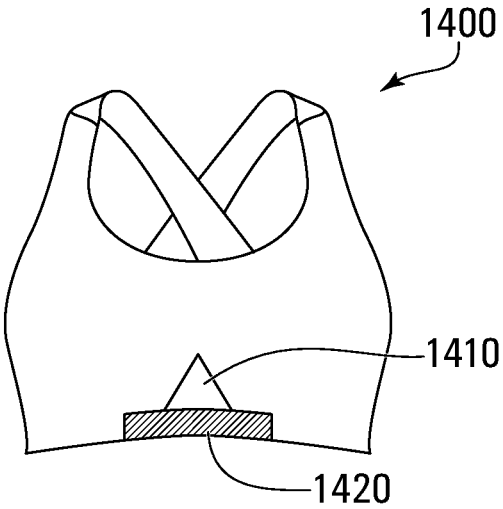
FIG. 8B is a front view of the garment of FIG. 8A.

A further example is shown in FIGS. 8A and 8B. Garment 1400 has a portion of the lower part of the front portion with a higher stretching level 1410, such as, for example, an opening or an opening comprising a mesh, which can aid in reducing respiratory restriction during activity as well as a moisture and temperature management. In this example, a portion of the underband 1420 adjacent to the portion with the higher stretching level 1410 has a lower stretching level to provide necessary support to the breast tissue to manage breast tissue acceleration during activity. The other portions of the underband may have lower stretching levels than portion 1420, such that portions 1410 and 1420 can aid in reducing respiratory restriction during activity without compromising necessary support that the garment 1400 provides during activity.

Figure 9A:
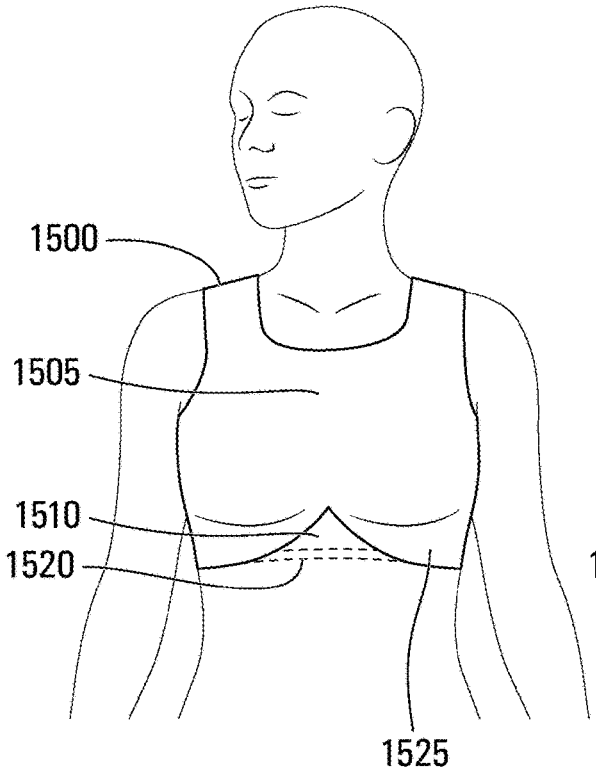
FIG. 9A is a front view of a garment with a zone having a higher stretching level on a front portion and underband as compared to a remainder of the front portion and underband of the garment, in accordance with an embodiment of the invention.
Figure 9B:
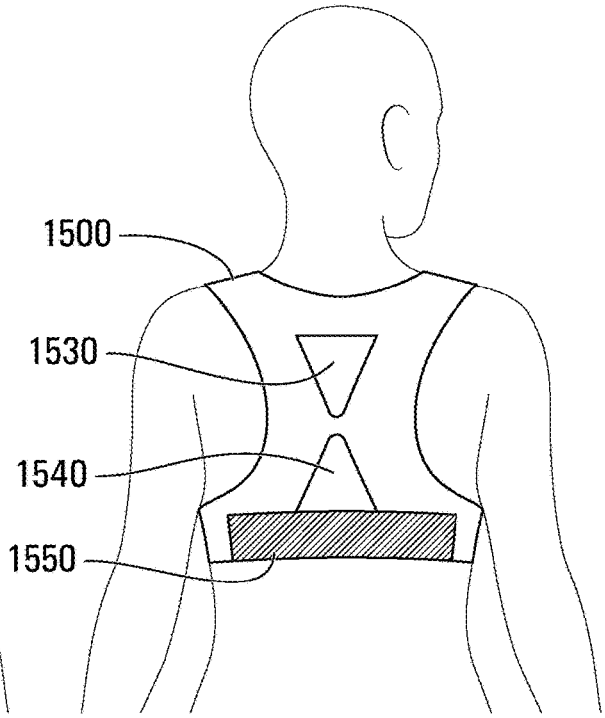
FIG. 9B is a back view of a garment with two openings and a zone having a higher stretching level on the underband as compared to a remainder of the underband of the garment, in accordance with an embodiment of the invention.

FIGS. 9A and 9B illustrate additional embodiments of the garment according to the invention where respiratory restriction reduction is provided by zones with higher stretching levels. FIG. 9A provides an additional example of a garment 1500 where a front portion 1505 of the garment 1500 and underband include zones 1510 and 1520, respectively, in the central part with a higher stretching level as compared to the stretching level of the remainder of the front portion 1505 and underband, respectively, of the garment 1500. In the illustrated example of FIG. 9A, the underband portion 1520 has a higher stretching level than the remainder of the underband and zone 1510 is an opening. In further embodiments, the underband zone 1520 may be omitted from the garment 1500 and zone 1510 is a depression in the shape of the front portion 1505 of the garment 1500. In such embodiments, the lower portion 1525 of the garment 1500 provides breast tissue support during activity, while the depression provides respiratory restriction reduction. FIG. 9B shows the garment 1500 with zones having a higher stretching level in the central part of the back portion and the central part of the underband, 1530, 1540 and 1550, respectively, as compared to the stretching level of the remainder of the back portion and underband, respectively.

While particular elements, embodiments and applications of the present application have been shown and described, it will be understood, that the scope of the application is not limited thereto, since modifications can be made by those skilled in the art without departing from the scope of the present application, particularly in light of the foregoing teachings. Thus, for example, in any method or process disclosed herein, the acts or operations making up the method/process may be performed in any suitable sequence and are not necessarily limited to any particular disclosed sequence. Elements and components can be configured or arranged differently, combined, and/or eliminated in various embodiments. The various features and processes described above may be used independently of one another, or may be combined in various ways. All possible combinations and subcombinations are intended to fall within the scope of this application. Reference throughout this disclosure to "some embodiments," "an embodiment," or the like, means that a particular feature, structure, step, process, or characteristic described in connection with the embodiment is included in at least one embodiment. Thus, appearances of the phrases "in some embodiments," "in an embodiment," or the like, throughout this disclosure are not necessarily all referring to the same embodiment and may refer to one or more of the same or different embodiments. Indeed, the novel methods and systems described herein may be embodied in a variety of other forms; furthermore, various omissions, additions, substitutions, equivalents, rearrangements, and changes in the form of the embodiments described herein may be made without departing from the spirit of the application.

Various aspects and advantages of the embodiments have been described where appropriate. It is to be understood that not necessarily all such aspects or advantages may be achieved in accordance with any particular embodiment. Thus, for example, it should be recognized that the various embodiments may be carried out in a manner that achieves or optimizes one advantage or group of advantages as taught herein without necessarily achieving other aspects or advantages as may be taught or suggested herein.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without operator input or prompting, whether these features, elements and/or steps are included or are to be performed in any particular embodiment. No single feature or group of features is required for or indispensable to any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

The example calculations, simulations, results, graphs, values, and parameters of the embodiments described herein are intended to illustrate and not to limit the disclosed embodiments. Other embodiments can be configured and/or operated differently than the illustrative examples described herein.

What is claimed is:

1. A garment comprising:

a front portion configured to cover at least a portion of a wearer's chest, the front portion comprising a front portion lower edge, a front portion upper edge portion, a first side of the front portion and a second side of the front portion;

a back portion configured to cover at least a portion of the wearer's back, the back portion comprising a back portion lower edge, a back portion upper edge portion, a first side of the back portion and a second side of the back portion;

a first side portion extending between the first side of the front portion and the second side of the back portion, the first side portion having a first lower edge;

a second side portion extending between the second side of the front portion and the first side of the back portion, the second side portion having a second lower edge; and a pair of reinforcing elements extending from the first side portion and the second side portion, respectively, toward the front portion, each of the pair of reinforcing elements being engineered to have varying stretching modules, wherein bottom zones of each of the pair of reinforcing elements closer to a lower edge of the garment have stretching levels greater than top zones of the reinforcing elements closer to an upper edge of the garment, wherein at least a part of the first and second side portions comprise two or more stretching module zones, the two or more stretching module zones comprising a low stretching module zone in proximity to a first arm opening and a second arm opening, respectively, of the garment, and a lower edge stretching module zone in proximity to the first lower edge and the second lower edge, respectively, wherein each of the pair of reinforcing elements comprises a first leg extending at least partially in a top part of the front portion in proximity to the front portion upper edge portion and a second leg extending at least partially in a bottom part of the front portion in proximity to the front portion lower edge, wherein at least part of the first and the second leg is shaped to provide lateral support of a breast tissue around a root of each breast, wherein the first leg and the second leg are arranged in a crisscross configuration within each of the pair of reinforcing elements and are configured to extend from the front portion across the respective side portion toward the back portion, the first leg having a first end in proximity to the front portion upper edge portion and a second end in proximity to the back portion lower edge, and the second leg having a first end in proximity to the front portion lower edge and a second end in proximity to the back portion upper edge portion.

2. The garment according to claim 1, wherein the first and second side portions are engineered such that a stretching level of the two or more stretching module zones increases gradually from the low stretching module zone towards the lower edge stretching module zone.

3. The garment according to claim 1, wherein the first and second side portions are engineered such that the two or more stretching module zones extend radially downward pivoting from the low stretching module zone toward the lower edge stretching module zone.

4. The garment according to claim 1, wherein each of the first and second side portions comprise a triangular shaped gusset, wherein the triangular shaped gusset is engineered such that the two or more stretching module zones extend radially downward pivoting from the low stretching module zone toward the lower edge stretching module zone.

5. The garment according to claim 1, wherein each of the pair of reinforcing elements is U-shaped, V-shaped, X-shaped or Y-shaped.

6. The garment according to claim 1, wherein stretching levels of the varying stretching modules of each of the reinforcing elements increases gradually from the top zones of the reinforcing elements toward the bottom zones of the reinforcing elements.

7. The garment according to claim 1, further comprising an underband at the lower edge of the front portion, the back portion and each of the first and second side portions.

8. The garment according to claim 7, wherein the underband is engineered such that a zone closer to a lower edge of the underband along each of the first and second side portions has a stretching module level greater than a zone further away from the lower edge of the underband.

9. The garment according to claim 7, wherein the underband is engineered such that a zone closer to a lower edge of the underband has a stretching module level greater than a zone further away from the lower edge of the underband.

10. The garment according to claim 7, wherein the underband is configured to have a concave shape, with a depression of the concave shape at center portions of the underband, such that a stretching level at sides of the underband is greater than at the center portions.

11. The garment according to claim 7, wherein the garment further comprises one or more openings on the front portion, the back portion, the first side portion, the second side portion, the underband or a combination thereof, wherein the one or more openings create one or more zones with a higher stretching level compared to zones of the garment without the one or more openings, and wherein the one or more zones with the higher stretching level is controlled by a size and/or density of the one or more openings.

12. The garment according to claim 11, wherein the one or more openings comprise a mesh.

13. The garment according to claim 11, wherein a zone with a lower stretching level is adjacent the one or more openings.

14. The garment according to claim 11, wherein the one or more openings are on a central part of the front portion, a central part of the back portion, a central part of the underband, or a combination thereof.

15. The garment according to claim 7, wherein the garment further comprises one or more zones on a center part of the front portion, a center part of the back portion, a center part of the underband or a combination thereof, having a higher stretching level compared to zones of the front portion, back portion and underband without the one or more zones having the higher stretching level.

16. The garment according to claim 1, further comprising one or more shoulder straps configured to connect the front portion and the back portion over one or both shoulders of the wearer.

17. A garment comprising:

a front portion configured to cover at least a portion of a wearer's chest, the front portion comprising a front portion lower edge, a front portion upper edge portion, a first side of the front portion and a second side of the front portion;

a back portion configured to cover at least a portion of the wearer's back, the back portion comprising a back portion lower edge, a back portion upper edge portion, a first side of the back portion and a second side of the back portion;

a first side portion extending between the first side of the front portion and the second side of the back portion, the first side portion having a first lower edge;

and a second side portion extending between the second side of the front portion and the first side of the back portion, the second side portion having a second lower edge, wherein at least a part of the first and second side portions comprise two or more stretching module zones, the two or more stretching module zones comprising a low stretching module zone in proximity to a first arm opening and a second arm opening, respectively, of the garment, a lower edge stretching module zone in proximity to the first lower edge and the second lower edge, respectively; and wherein each of the first and second side portions comprise a triangular shaped gusset, wherein the triangular shaped gusset is engineered such that the two or more stretching module zones extend radially downward pivoting from the low stretching module zone toward the lower edge stretching module zone further comprising a pair of reinforcing elements extending from the first side portion and the second side portion, respectively, toward the front portion, each of the pair of reinforcing elements comprises a first leg extending at least partially in a top part of the front portion in proximity to the front portion upper edge portion and a second leg extending at least partially in a bottom part of the front portion in proximity to the front portion lower edge, wherein the first leg and the second leg are arranged in a crisscross configuration within each of the pair of reinforcing elements and are configured to extend from the front portion across the respective side portion toward the back portion, wherein each of the pair of reinforcing elements is engineered to have varying stretching modules, wherein bottom zones of each of the pair of reinforcing elements closer to a lower edge of the garment have stretching levels greater than top zones of the reinforcing elements closer to an upper edge of the garment.

18. The garment according to claim 17, wherein at least part of the first and the second leg is shaped to provide lateral support of a breast tissue around a root of each breast.

* * * * *